US008708526B2

(12) United States Patent
Wu

(10) Patent No.: US 8,708,526 B2
(45) Date of Patent: Apr. 29, 2014

(54) LED STREET LAMP

(75) Inventor: Hongge Wu, Guangdong (CN)

(73) Assignee: Dongguan Kingsun Optoelectronic Co., Ltd, Dongguan (CN)

( * ) Notice: Subject to any disclaimer, the term of this patent is extended or adjusted under 35 U.S.C. 154(b) by 0 days.

(21) Appl. No.: 13/702,581

(22) PCT Filed: Oct. 9, 2010

(86) PCT No.: PCT/CN2010/077609

§ 371 (c)(1),
(2), (4) Date: Dec. 7, 2012

(87) PCT Pub. No.: WO2011/153761

PCT Pub. Date: Dec. 15, 2011

(65) Prior Publication Data

US 2013/0088861 A1 Apr. 11, 2013

(30) Foreign Application Priority Data

Jun. 8, 2010 (CN) ..... 2010 2 0220200
Jun. 8, 2010 (CN) ..... 2010 2 0220206
Jun. 8, 2010 (CN) ..... 2010 2 0220216
Jun. 8, 2010 (CN) ..... 2010 2 0220219

(51) Int. Cl.
*F21L 4/02* (2006.01)
*F21V 29/00* (2006.01)
*F21V 21/00* (2006.01)
*F21L 4/00* (2006.01)
*F21V 5/00* (2006.01)

(52) U.S. Cl.
USPC ..... 362/249.02; 362/184; 362/190; 362/244

(58) Field of Classification Search
USPC ..... 362/84, 294.02, 311, 284; 313/498–512
See application file for complete search history.

(56) References Cited

U.S. PATENT DOCUMENTS 8,454,194 B2 * 6/2013 Liu ..... 362/218

OTHER PUBLICATIONS

ZiJlan et al., Chinese Patent Application Publication 201475921, May 2010, machine translation.*
Jle Shi, Chinese Patent Application CN10148224 Jul. 2009, machine translation.*
Jle Shi, Chinese Patent Application, CN10148224, Jul. 2009, Chinese translation.*

* cited by examiner

*Primary Examiner* — Tracie Y Green

(57) ABSTRACT

A LED street lamp comprises a connector, a power supply assembly and a light source assembly, the connector is provided with a structure of internal toothed rings, the light source assembly comprises two supporting aims and a plurality of light source modules, the assembling and disassembling of the street lamp are convenient and the maintenance cost is thereby decreased.

16 Claims, 5 Drawing Sheets

LED STREET LAMP

FIELD OF THE INVENTION

The present invention relates to a LED street lamp for roadway lighting.

BACKGROUND OF THE INVENTION

A LED street lamp generally comprises a power supply module and a light source module, while there is a high failure rate in the power supply module, which makes the module more prone to failure than other components. The power supply module or the light source module is usually mounted in a housing with the housing covered by a cover through screws, and an operator has to remove these screws when opening the lamp body, which makes the maintenance of the lamp difficult for the operator as the lamp body is placed high above the ground, the maintenance costs is thereby increased. Existing light source module usually comprises a radiator, a LED light board and lenses, while the damaged light source module would be entirely replaced by news ones when its LED luminous chip has been damaged, thus the existing light source module is inferior in flexibility and of high maintenance costs. Existing lamp connector cannot be rotated and thus its angles could not be adjusted according to the actual needs. The integrated structure of power supply module and light source module is lack of rationality and gives difficulties in maintenance. Since the maintenance of LED street lamps should be done as soon as possible, the inferior compositionality and the inferior generality of the existing light source module make the maintenance inconvenient, which is caused by the entire replacement of the light source module.

SUMMARY OF THE INVENTION

To overcome the above shortcomings in the prior art, the object of the present invention is to provide a LED street lamp, a power supply assembly of LED street lamp carrying with a rotary connector, supporting arm for mounting light source modules of LED street lamp and a power supply assembly of LED street lamp.

The invention fulfills the foregoing object by providing the following technical solutions:

A LED street lamp comprising: a power supply assembly, comprising a power supply body carrying with a cover and a circuit module, one end of the cover being connected with the power supply body through a hinge, a structure of power supply cavity with two side walls being formed when molding the power supply body, two half outside walls being formed respectively on two sides of the power supply cavity when molding it, two cover side walls in accordance with the shape of the half outside walls being provided by two sides of the cover, a reinforcing beam being arranged between the half outside wall and the side wall and being positioned in the middle portion of the half outside wall or the side wall, space being formed by the half outside wall, the reinforcing beam and the side wall, the space being covered and sealed by the cover side wall; a light source assembly, comprising two supporting arms respectively mounted on the side walls of the power supply cavity and a plurality of light source modules mounted between two said supporting arms, one end of each of the supporting arms being mounted in said space, while the other end being mounted on an end cover for forming an integrated structure; and a street lamp connector, being rotatably connected to the power supply body at its end.

The LED street lamp, wherein the street lamp connector characteristic of hollow T-shape, has two internal toothed rings with locating slots respectively provided on two side of one end of the street lamp connector; external toothed rings are mounted on two fixation plates respectively which are arranged on one end of the power supply body, the external toothed rings are sleeved with the internal toothed rings, via a screw pierced a screw hole of the external toothed ring to locate in a locating slot provided by the internal toothed ring to achieve rotatable connection therebetween.

The LED street lamp, wherein the cover of the power supply assembly has openings at the other end thereof, spring plates with hooks are fixed on one end of the power supply body, when the cover is closed, the hooks of the spring plates lock up the openings so as to fix the cover, after the spring plates have been pressed inward to loosen the hooks, an upward rotation of the cover could make the cover open.

The LED street lamp, wherein the circuit module comprises a light-controlling module and a power supply module, the light-controlling module is mounted in a through-hole provided by the cover, and the power supply module is mounted in the power supply cavity, The LED street lamp, wherein two sides of the power supply module are provided with power supply fixation plates, while the power supply cavity has slots, the power supply fixation plates are inserted into the slots to horizontally mount the power supply module on the bottom of the power supply cavity; when the cover is closed, one end of the light-controlling module which end is inside the cover is pressed against an upper surface of the power supply module.

The LED street lamp, wherein the supporting arm is a metal tube, and the outer side of the metal tube's cross-section is semicircle shape, the inner side of the supporting arm provides a supporting step having a plurality of mounting holes.

The LED street lamp, wherein the light source module comprises a lens pressing plate, a lens array, a LED light board and a radiator, the LED light board is mounted on, the surface of the radiator, the lens array covers the bulbs arranged on the LED light board, the lens pressing plate covers the lenses and presses the edges of the lenses, the lens pressing plate has an edge to encircle the sides of the radiator, the ends of the radiator have mounting holes which enable the radiator to be mounted on the supporting step through screws.

A power supply assembly of LED street lamp comprising a power supply body carrying with a cover and a circuit module, one end of the cover being connected with the power supply body through a hinge, a structure of power supply cavity with two side walls being formed when molding the power supply body, two half outside walls being formed respectively on two sides of the power supply cavity of the power supply body when molding it, two cover side walls in accordance with the shape of the half outside walls being provided by two sides of the cover, a reinforcing beam being arranged between the half outside wall and the side wall and being positioned in the middle portion of the half outside wall or the side wall, space being formed by the half outside wall, the reinforcing rib and the side wall, the space being covered and sealed by the cover side wall.

A street lamp connector of LED street lamp, characterized in that the street lamp connector characteristic of hollow T-shape, has two internal toothed rings with locating slots respectively provided on two side of one end of the street, lamp connector.

A light source assembly of LED street lamp comprising two supporting arms and a plurality of light source modules mounted between said two supporting arms, one end of each of the supporting arms being mounted on an end cover for forming an integrated structure; the light source module comprising a lens pressing plate, a lens array, a LED light board and a radiator, the LED light board being mounted on the surface of the radiator, the lens array covering the bulbs arranged on the LED light board, the lens pressing plate covering the lenses and pressing the edges of the lenses, the lens pressing plate having an edge to encircle the sides of the radiator, the ends of the radiator having mounting holes which enable the radiator to be mounted on the supporting step through screws.

The invention fulfills the foregoing object by providing the following technical solutions:

A power supply assembly of LED street lamp carrying with a rotary connector comprising: a cover being connected with the power supply body through a hinge; a power supply body, a structure of power supply cavity with two side walls being formed when molding the power supply body, two half outside walls being formed respectively on two sides of the power supply cavity when molding it, two cover side walls in accordance with the shape of the half outside walls being provided by the two sides of the cover, a reinforcing beam being arranged between the half outside wall and the side wall and being positioned in the middle portion of the half outside wall or the side wall, space being formed by the half outside wall, the reinforcing beam and the side wall, the space being covered and sealed by the cover side wall; a street lamp connector, being rotatably connected to the power supply body at its end.

The power supply assembly of LED street lamp, wherein the street lamp connector characteristic of hollow T-shape, has two internal toothed rings with locating slots respectively provided on two side of one end of the street lamp connector; external toothed rings are mounted on two fixation plates respectively which are arranged on one end of the power supply body, the external toothed rings are sleeved with the internal, toothed rings, via a screw pierced a screw hole of the external toothed ring to locate in a locating slot provided by the internal toothed ring to achieve rotatable connection therebetween.

The power supply assembly of LED street lamp, wherein the power supply body comprises a power supply module and a light-controlling module, the light-controlling module is mounted in a through-hole provided by the cover, and the power supply module is mounted in the power supply cavity.

The power supply assembly of LED street lamp, wherein two sides of the power supply module are provided with power supply fixation plates, while the power supply cavity has slots, the power supply fixation plates are inserted into the slots to horizontally mount the power supply module on the bottom of the power supply cavity; when the cover is closed, one end of the light-controlling module which end is inside the cover is pressed against an upper surface of the power supply module.

The power supply assembly of LED street lamp, wherein the cover has openings at the other end thereof, spring plates with hooks are fixed on one end of the power supply body, when the cover is closed, the hooks of the spring plates lock up the openings so as to fix the cover, after the spring plates have been pressed inward to loosen the hook, an upward rotation of the cover could make the cover open.

The power supply assembly of LED street lamp, wherein the cover has openings at the other end thereof, spring plates with hooks are fixed on one end of the power supply body, when the cover is closed, the hooks of the spring plates lock up the openings so as to fix the cover, after the spring plates have been pressed inward to loosen the hook, an upward rotation of the cover could make the cover open.

A power supply body of LED street lamp, characterized in that: a structure of power supply cavity with two side walls is formed when molding the power supply body, two half outside walls are formed respectively on two sides of the power supply cavity, two cover side walls in accordance with the shape of the half outside walls are provided by two sides of a cover, a reinforcing beam is arranged between the half outside wall and the side wall and is positioned in the middle portion of the half outside wall or the side wall, space is formed by the half outside wall, the reinforcing beam and the side wall, the space is covered and sealed by the cover side wall.

A street lamp connector of LED street lamp, characterized in that: the street lamp connector characteristic of hollow T-shape, has two internal toothed rings with locating slots respectively provided on two side of one end of the street lamp connector.

The invention fulfills the foregoing object by providing the following technical solutions:

A supporting arm for mounting light source modules of LED street lamp, characterized in that: the body of the supporting arm is presented as a tube, the outer side of its cross-section is semicircle shape, while the inner side of its cross-section is rectangle shape, the rectangle cross-section has a recess thereon to form a supporting step for mounting light source modules the supporting step is provided with a plurality of mounting holes for mounting the light source modules, one end of the inner side of the rectangle cross-section is provided with a plurality of mounting holes for mounting power supply assembly.

The supporting arm for mounting light source modules of LED street lamp, wherein at one end of the supporting arm, the inner side of said semicircle is provided with a plurality of mounting holes for mounting an end cover.

The invention fulfills the foregoing object by providing the following technical solutions:

A light source assembly of LED street lamp, comprising two supporting arms respectively mounted on side walls of the power supply cavity and a plurality of light source modules mounted between two said supporting arms, one end of each of the two supporting arms being mounted on an end cover for forming an integrated structure; the inner side of the supporting arm providing a supporting step, the supporting step having a plurality of mounting holes, the light source modules being arranged side by side between the two supporting arms and being bridged on the supporting steps of the supporting arms.

The light source assembly of LED street lamp, wherein the supporting arm is a metal tube, and the outer side of the metal tube's cross-section is semicircle shape.

The light source assembly of LED street lamp, wherein the light source module comprises a lens pressing plate, a lens array, a LED light board and a radiator, the LED light board is mounted on the surface of the radiator, the lens array covers the bulbs arranged on the LED light board, the lens pressing plate covers the lenses and presses the edges of the lenses, the lens pressing plate has an edge to encircle the sides of the radiator, ends of the radiator have mounting holes which enable the radiator to be mounted on the supporting step through screws.

A light source module of light source assembly of LED street lamp, comprising a lens pressing plate, a lens array, a LED light board and a radiator, the LED light board being mounted on the surface of the radiator, the lens array covering the bulbs arranged on the LED light board, the lens pressing plate covering the lenses and pressing the edges of the lenses, the lens pressing plate having an edge to encircle the sides of the radiator, the ends of the radiator having mounting holes.

The light source module, wherein the radiator is consisted of heat diffusion substrates, and a plurality of heat diffusion slices arranged perpendicular to the substrates.

The light source module, wherein the substrate is presented as a cuboid structure.

A radiator for light source module of LED street lamp, characterized in that it consists of heat diffusion substrates and a plurality of heat diffusion slices arranged perpendicular to the substrates, the substrate is presented as a cuboid structure, the substrate has waterproof eaves to surround it and has mounting holes at its ends.

The positive effects of certain technical solutions of the present invention arc as follows: 1. the cover is connected with the lamp body though hinges and hooks, after the hooks have been loosened, an upward rotation of the cover could make the cover open, which facilitate the maintenance; the power supply fixation plates are inserted into the slots to horizontally mount the power supply module on the bottom of the power supply cavity, and the power supply module is pressed by one end of the light-controlling module which end is located in the inner side of the cover, thus the power supply module and the lamp body are mounted together without any screw, when there is a need to replace the power supply module, just open the cover first and then remove the power supply module from the slots; 2. the street lamp connector connects with the power supply assembly though the internal toothed rings and the external toothed rings, bolts pierce the locating slots as well as the locating holes to locate the street lamp connector, thereby the angle between the street lamp connector and the lamp body can be kept at a designed degree, in addition, the rotation of the connector and the lamp body could be done easily when adjusting angles; 3. the light source assembly is consisted of a plurality of light source modules, these modules are arranged side by side between the two supporting arms, and the modules are bridged on the supporting steps of the supporting arms, two ends of the light source module are mounted on the supporting steps through screws, and there is no connection between any two light source modules, thereby when some of the modules are being maintained, the other modules would not be affected. The length of the supporting arms could be altered when it is designed so as to get the required length, more light source modules could be mounted when there are longer length supporting arms, which fulfills the needs for various conditions.

The positive effects of certain technical solutions of the present invention are as follows: 1. the cover is connected with the lamp body though hinges and hooks, after the hooks have been loosened, an upward rotation of the cover could make the cover open, which facilitate the maintenance; the power supply fixation plates are inserted into the slots to horizontally mount the power supply module on the bottom of the power supply cavity, and the power supply module is pressed by one end of the light-controlling module which end is located in the inner side of the cover, thus the power supply module and the lamp body are mounted together without any screw, when there is a need to replace the power supply module, just open the cover first and then remove the power supply module from the slots; 2. the street lamp connector connects with the power supply assembly though the internal toothed rings and the external toothed rings, bolts pierce the locating slots as well as the locating holes to locate the street lamp connector, thereby the angle between the street lamp connector and the lamp body can be kept at a designed degree, in addition, the rotation of the connector and the lamp body could be done easily when adjusting angles; 3. the reinforcing beam, is arranged between the half outside wall and the side wall and is positioned in the middle portion of the half outside wall or the side wall, the space formed by the half outside wall, the reinforcing rib and the side wall is used for holding the supporting arm of the light source module, the space is covered and sealed by the cover side wall. Thereby mounting of the light source module is flexible and the further maintenance is also convenient.

The positive effects of certain technical solutions of the present invention are as follows: 1. a plurality of light source modules are bridged on the supporting arms through the supporting steps provided by the supporting arms, the supporting arms connects with the light source assembly to form a integral structure via the mounting holes arranged in the inner side of one end of the supporting arms, while the supporting arms connects with the end cover via the mounting holes arranged in the inner side of the outer circle, this installation structure is very stable and could facilitate the replacement of the damaged light source module, and the length of the supporting arms is adjustable which could meet the needs of various power, thereby the product has a rational structure and is of flexibility that would lead to a strong market demand for the LED street lamp.

The positive effects of certain technical solutions of the present invention are as follows: the light source assembly is consisted of a plurality of light source modules, these modules are arranged side by side between the two supporting arms, and the light source modules are bridged on the supporting steps of the supporting arms, tow ends of each module are mounted on the supporting steps through screws, and there is no connection between any two light source modules, thereby when some of the modules are being maintained, the other modules would not be affected. The length of the supporting arms could be altered when it is designed so as to get the required length, more light source modules could be mounted when there are longer length supporting arms, which fulfills the needs for various conditions. The further maintenance is also convenient.

Detail description of the technical solution of the present invention will be described as follows in accompany with drawings.

DETAILED DESCRIPTION OF THE PREFERRED EMBODIMENTS OF THE INVENTION

Figure 1:
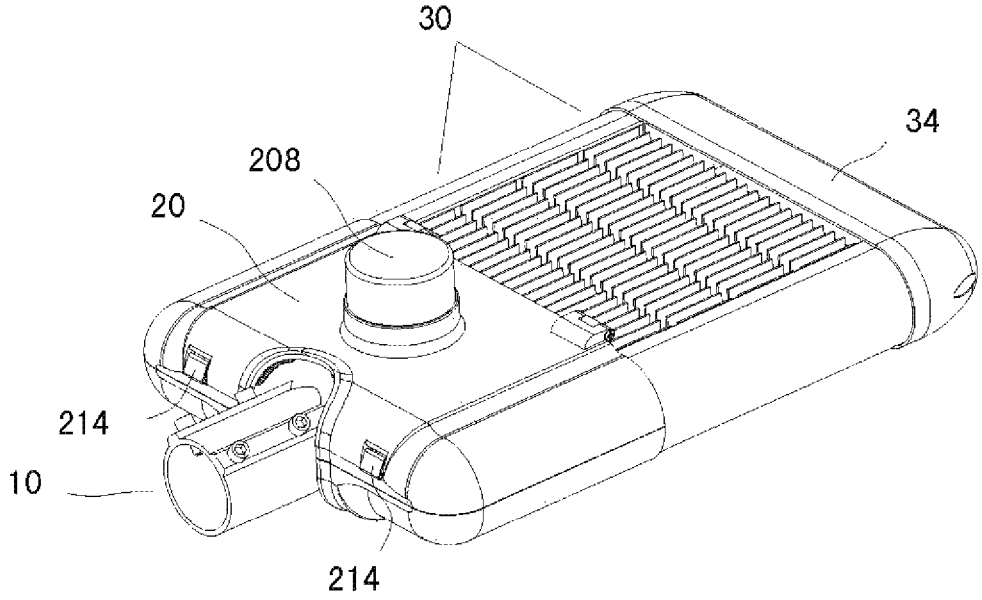
FIG. 1 is a schematic diagram of the LED street lamp of the present invention.

To understand and to practice the present invention, detailed descriptions of the present invention in accompany with the drawings are as follows:

Referring to FIG. 1, a LED street lamp comprises a street lamp connector 10, a power supply assembly 20 and a light source assembly 30.

Figure 5A:
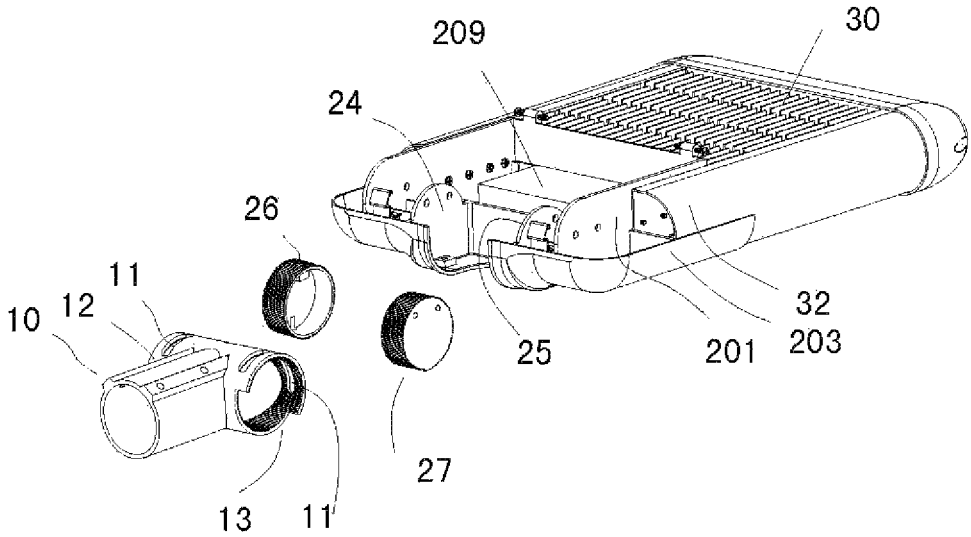
FIG. 5*a* is a schematic diagram of the disconnected street lamp connector of the present invention.
Figure 5B:
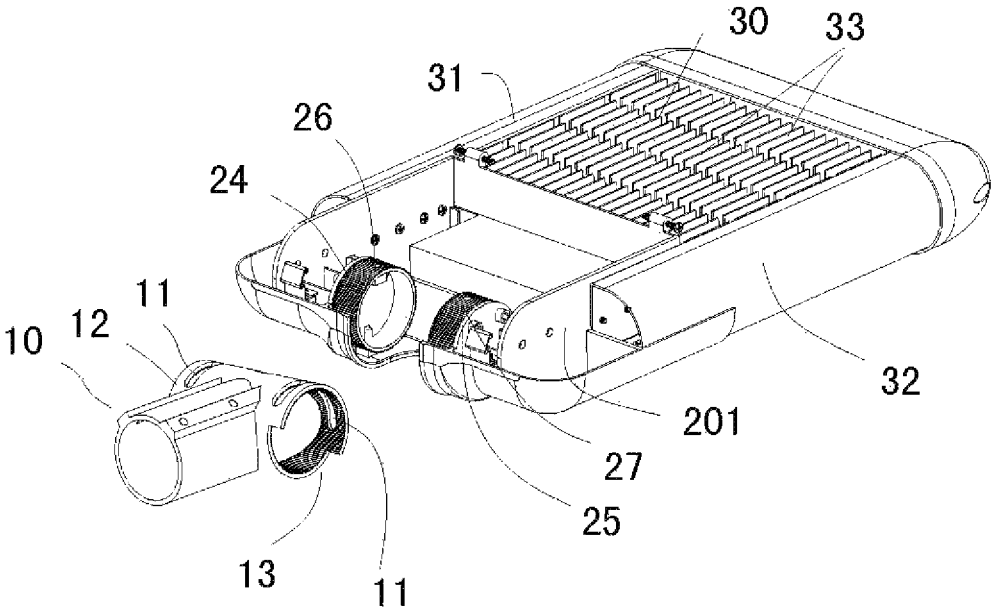
FIG. 5*b* is a schematic diagram of the assembled street lamp connector.

Referring to FIG. 5*a* and FIG. 5*b*, the street lamp connector 10 is characteristic of hollow T-shape, and two internal toothed rings 12, 13 with locating slots 11 are respectively provided by two sides of one end of the connector.

Figure 2:
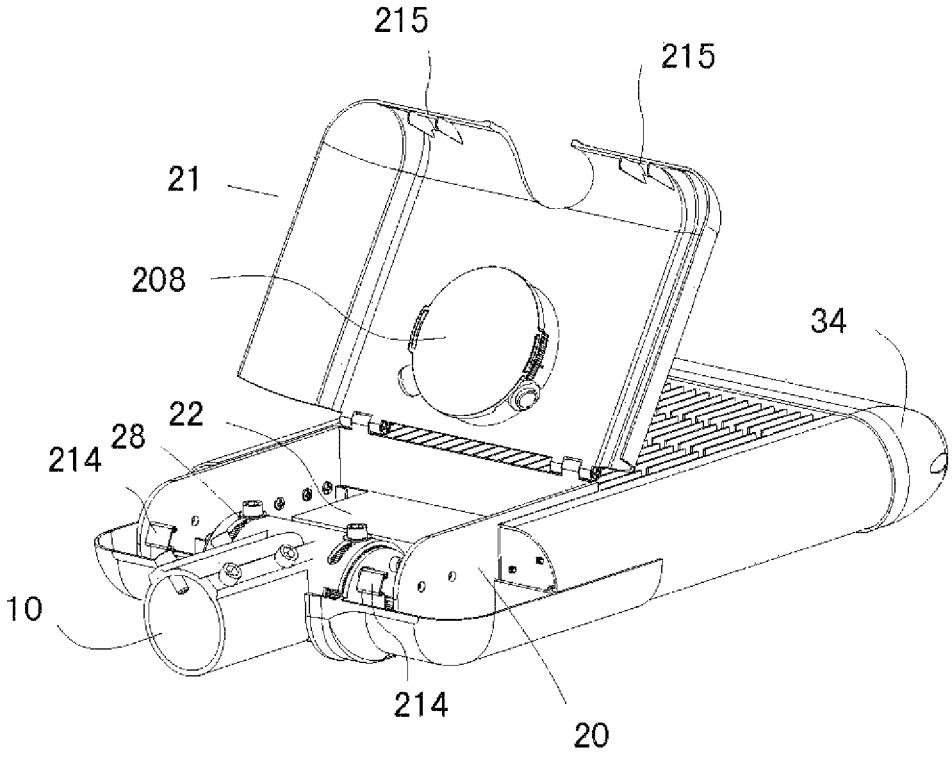
FIG. 2 is a schematic diagram of the LED street lamp of the present invention as viewed in FIG. 1 with opening the cover.
Figure 3:
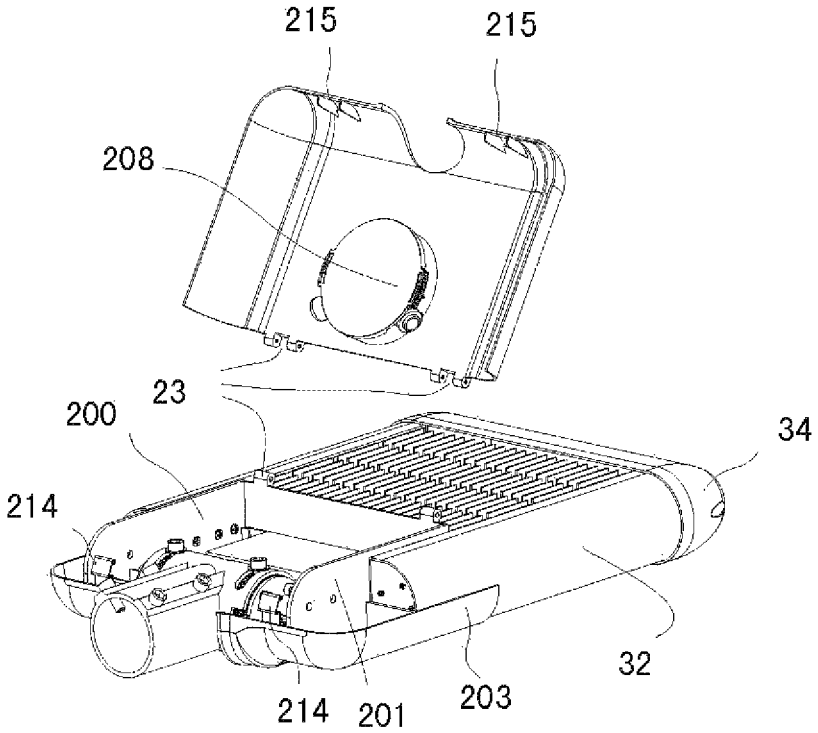
FIG. 3 is a schematic diagram of the LED street lamp of the present invention as viewed in FIG. 1 with disconnecting the cover.

Referring to FIG. 2 and FIG. 3, the power supply assembly 20 comprises a power supply body carrying with a cover 21 and a circuit module, one end of the cover 21 connects with the power supply body through a hinge 23, and a structure of cavity 22 is provided by the power supply body. Referring to FIG. 5*a* and FIG. 5*b*, one end of the power supply body are provided with two fixation plates 24, 25 respectively for fixing external toothed rings 26, 27 the external toothed rings 26, 27 are sleeved with the internal toothed rings 12, 13 respectively, via a screw 28 pierced a screw hole of the external toothed ring to locate in a locating slot 11 provided by the internal toothed ring to achieve rotatable connection therebetween.

Figure 6:
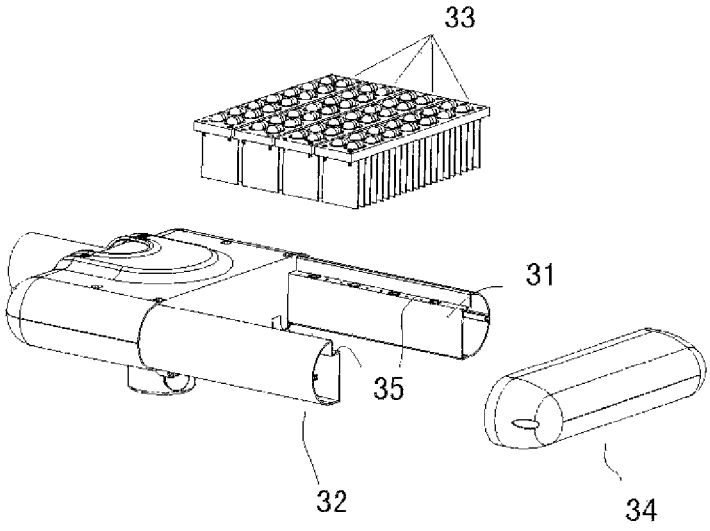
FIG. 6 is a schematic diagram of the assembled light source assembly.

Referring to FIG. 6, the light source assembly 30 comprises two supporting arms 31, 32 respectively mounted on side walls 200, 201 of the power supply cavity and a plurality of light source modules 33 mounted between two said supporting arms, the other end of each of the supporting arms 31, 32 is mounted on an end cover 34 for forming an integrated structure.

Figure 4A:
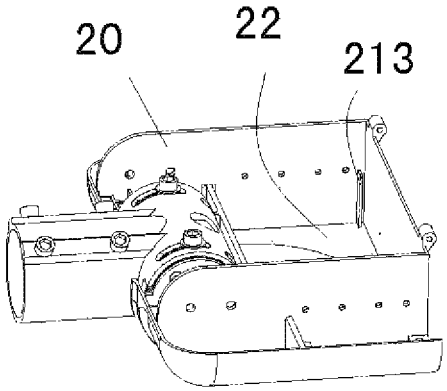
FIG. 4*a* is a schematic diagram of the power supply body of the present invention.
Figure 4B:
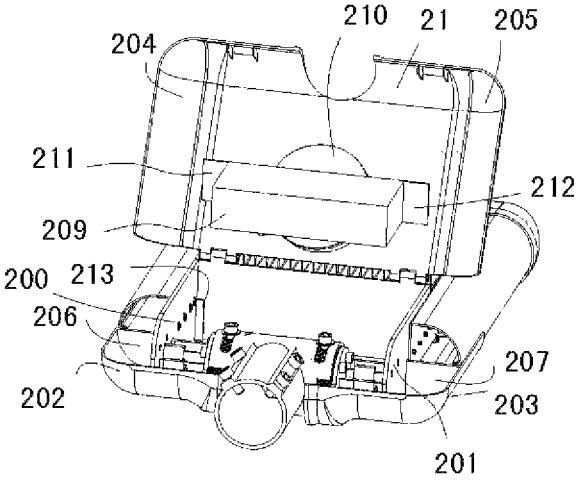
FIG. 4*b* is a schematic diagram of the disconnected power supply assembly of the present invention.
Figure 7:
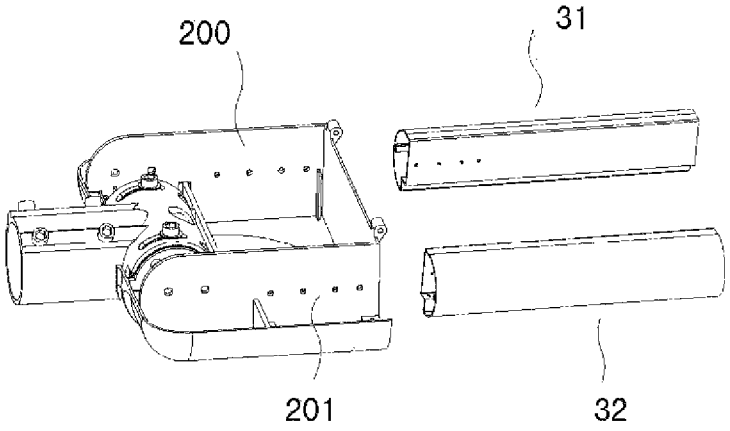
FIG. 7 is a schematic diagram of the supporting aims of the light source assembly.

Referring to FIG. 4*a*, FIG. 4*b* and FIG. 7, two half outside walls 202, 203 are formed respectively on two sides of the power supply cavity 22 of the power supply assembly 20 when molding it, two cover side walls 204, 205 in accordance with the shape of the half outside walls are provided by two sides of the cover 21, reinforcing beams 206, 207 are arranged between the half outside walls and the side walls and are positioned in the middle portion of the half outside walls or the side walls, the end of the supporting arm 32 which end is fixed to the side wall, is arranged in a space formed by the half outside wall 203, the reinforcing beam 207 and the side wall 201, the space is covered and sealed by the cover side wall, likewise, the supporting arm 31 is arranged with the same mounting structures symmetrically on the opposite side.

Referring to FIG. 3, FIG. 4*a* and FIG. 4*b*, the circuit module comprises a light-controlling module 208 and a power supply module 209, the light-controlling module 208 is mounted in the through-hole 210 provided by the cover 21, and the power supply module 209 is mounted in the power supply cavity 22. Two sides of the power supply module 209 are provided with power supply fixation plates 211, 212, while the power supply cavity has slots 213, the power supply fixation plates are inserted into the slots to horizontally mount the power supply module on the bottom of the power supply cavity 22; when the cover 21 is closed, one end of the light-controlling module 208 which end is inside the cover 21 is pressed against an upper surface of the power supply module 209.

Referring to FIG. 2 and FIG. 3, the cover 21 has openings 215 at the other end thereof, spring plates 214 with hooks are fixed on one end of the power supply body, when the cover 21 is closed, the hooks of the spring plates 214 lock up the openings 215 so as to fix the cover, after the spring plates 214 have been pressed inward to loosen the hooks, an upward rotation of the cover could make the cover open.

Referring to FIG. 6, the supporting arm 31 is a metal tube, and the outer side of the metal tube's cross-section is semi-circle shape, the inner side of the supporting arm provides a supporting step 35 having a plurality of mounting holes.

Figure 8:
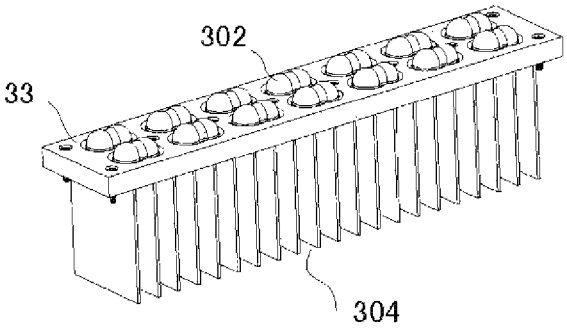
FIG. 8 is a schematic diagram of single light source module of the present invention.
Figure 9A:
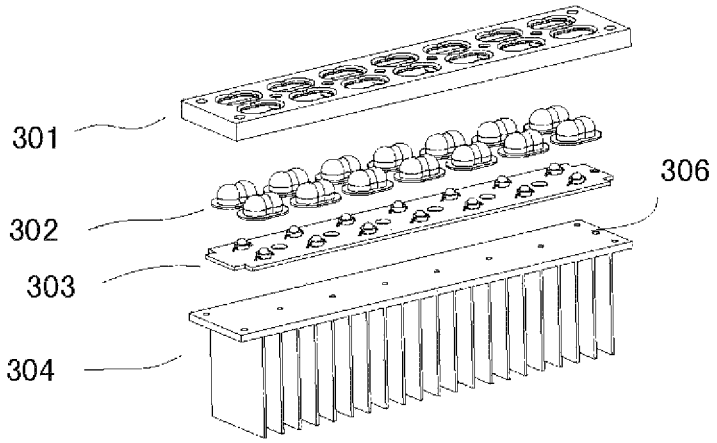
FIG. 9*a* is an explosive view of single light source module of the present invention.
Figure 9B:
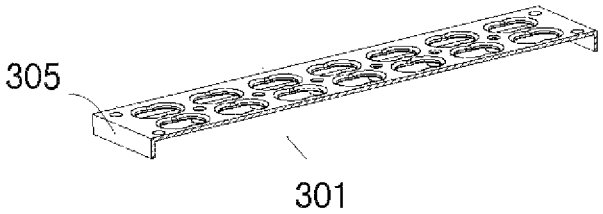
FIG. 9*b* is a cross-section view of the lens pressing plate of the present invention.

Referring to FIG. 8, FIG. 9*a* and FIG. 9*b*, the light source module 33 comprises a lens pressing plate 301, a lens array 302, a LED light board 303 and a radiator 304, the LED light board 303 is mounted on the surface of the radiator 304, the lens array 302 covers the bulbs arranged on the LED light board 303, the lens pressing plate 301 covers the lenses and presses the edges of the lenses, the lens pressing plate 301 has an edge 305 to encircle the sides of the radiator 304, the ends of the radiator have mounting holes 306 which enable the radiator to be mounted on the supporting step 35 through screws, see FIG. 6.

The structural features of the LED street lamp of the present invention will be illustrated in detail.

The cover provides the light-controlling assembly, the light source module is exposed without housing.

The power supply cavity has the power supply module mounted therein, and the cavity is sealed by the cover. The cover is, provided with the light-controlling module which makes the lamp turn itself off in light environment and turn itself on in the dark. One end of the cover connects with the lamp body through the hinge, and the other end provides the openings, the spring plates with hooks are fixed on one end of the lamp body, when the cover is closed, the hooks of the spring plates lock up the openings so as to fix the cover, see FIG. 1 After the spring plates have been pressed inward to loosen the hooks, an upward rotation of the cover could make the cover open.

Referring to FIG. 4, Two sides of the power supply module are provided with the power supply fixation plates, while the power supply cavity has the slots, the power supply fixation plates are inserted into the slots to horizontally mount the power supply module on the bottom of the power supply cavity; when the cover is closed, one end of the light-controlling module which end is inside the cover is pressed against the upper surface of the power supply module, while the lower surface of the power supply module is placed on the bottom of the power supply cavity, thus the power supply module is in contacts with the lamp body and is vertically fixed, that is, the power supply module and the lamp body are fixed together without any screw. When there is a need to replace the power supply module, just open the cover first and then remove the power supply module from the slots.

Referring to FIG. 5, the connection structure between the street lamp connector and the lamp body comprises the internal toothed rings provided by the street lamp connector, independent external toothed rings and the fixation plates provided by the lamp body for fixing the external toothed rings. The internal toothed rings are molded integrally with the street lamp connector, and the fixation plates for fixing the external toothed rings are molded integrally with the lamp body. When installing these components, the external toothed rings are fixed to the fixation plates first, the external toothed rings are then sleeved with the internal toothed rings, bolts are used to pierce the locating slots as well as the locating holes to locate the connector, thereby the angle between the connector and the lamp body can be kept, at a designed degree, alternatively, the external toothed rings could be sleeved with the internal toothed rings first and followed by a fixation though bolts, then the external toothed rings are fixed to the fixation plates. The inner diameter of internal toothed rings is slightly larger than the outer diameter of external toothed rings which facilitates the rotation of them when adjusting angles. The internal toothed rings engage with the external toothed rings at their top to be fixed.

Referring to FIG. 6, the light source assembly is consisted of a plurality of light source modules, these modules are arranged side by side between the two supporting arms, and the modules are bridged on the supporting steps of the supporting arms. Tow ends of each light source module are mounted on the supporting steps through screws, and there is no connection between any two light source modules, thereby when some of the modules are being maintained, the other modules would not be affected. Tow ends of each module are mounted on the supporting steps through screws. Referring to FIG. 7, the supporting arm is a metal tube, and its cross-section is semicircle shape, the supporting arm is fixed to the side wall of the power supply cavity through bolts. The outside surface of the end cover, the half outside walls of the power supply cavity and the half outside walls of the cover all have the curved surfaces that in accordance with the shape of the supporting arms, which makes the fixation of the supporting arms very stable and strong. The length of the supporting arm could be altered when it is designed so as to get the required length, more light source modules could be mounted when there are longer length supporting arms, which decreases the maintenance costs.

Referring to FIG. 8, FIGS. 9*a* and 9*b*, the light source module comprises the lens pressing plate, the lens array, the LED light board and a radiator. The LED light board is mounted on the surface of the radiator, the lens array covers the bulbs that arranged on the LED light board, the lens pressing plate covers the lenses and presses the edges of the lenses, the lens pressing plate has an edge to encircle the sides of the radiator, which improves the waterproof performance of the LED street lamp.

The power supply assembly independently constitutes an example of the present invention:

Referring to FIG. 1, a LED street lamp comprises a street lamp connector 10, a power supply assembly 20 and a light source assembly 30.

Referring to FIG. 5*a* and FIG. 5*b*, the street lamp connector 10 is characteristic of hollow T-shape, and two internal toothed rings 12, 13 with locating slots 11 are respectively provided by two sides of one end of the connector.

Referring to FIG. 2 and FIG. 3, the power supply assembly 20 comprises a power supply body carrying with a cover 21 and a circuit module, one end of the cover 21 connects with the power supply body through a hinge 23. Referring to FIG. 5*a* and FIG. 5*b*, one end of the power supply body are provided with two fixation plates 24, 25 respectively for fixing external toothed rings 26, 27, the external toothed rings 26, 27 are sleeved with the internal toothed rings 12, 13 respectively, via a screw 28 pierced a screw hole of the external toothed ring to locate in a locating slot 11 provided by the internal toothed ring to achieve rotatable connection therebetween.

Referring to FIG. 6, the light source assembly 30 comprises two supporting arms 31, 32 respectively mounted on side walls 200, 201 of the power supply cavity and a plurality of light source modules 33 mounted between two said supporting arms, the other end of each of the supporting arms 31, 32 is mounted on an end cover 34 for forming an integrated structure.

Referring to FIG. 4*a*, FIG. 4*b* and FIG. 7, two half outside walls 202, 203 are formed respectively on two sides of the power supply cavity 22 of the power supply assembly 20 when molding it, two cover side walls 204, 205 in accordance with the shape of the half outside walls are provided by two sides of the cover 21, reinforcing beams 206, 207 are arranged between the half outside walls and the side walls and are positioned in the middle portion of the half outside walls or the side walls, the end of the supporting arm 32 which end is fixed to the side wall, is arranged in a space formed by the half outside wall 203, the reinforcing beam 207 and the side wall 201 the space is covered and sealed by the cover side wall, likewise, the supporting arm 31 is arranged with the same mounting structures symmetrically on the opposite side.

Referring to FIG. 3, FIG. 4*a* and FIG. 4*b*, the circuit module comprises a light-controlling module 208 and a power supply module 209, the light-controlling module 208 is mounted in the through-hole 210 provided by the cover 21, and the power supply module 209 is mounted in the power supply cavity 22. Two sides of the power supply module 209 are provided with power supply fixation plates 211, 212, while the power supply cavity has slots 213, the power supply fixation plates are inserted into the slots to horizontally mount the power supply module on the bottom of the power supply cavity 22; when the cover 21 is closed. one end of the light-controlling module 208 which end is inside the cover 21 is pressed against an upper surface of the power supply module 209.

Referring to FIG. 2 and FIG. 3, the cover 21 has openings 215 at the other end thereof, spring plates 214 with hooks are fixed on one end of the power supply body, when the cover 21 is closed, the hooks of the spring plates 214 lock up the openings 215 so as to fix the cover, after the spring plates 214 have been pressed inward to loosen the hooks, an upward rotation of the cover could make the cover open.

Referring to FIG. 6, the supporting arm 31 is a metal tube, and the outer side of the metal tube's cross-section is semicircle shape, the inner side of the supporting arm provides a supporting step 35 having a plurality of mounting holes.

The structural features of the LED street lamp of the present invention will be illustrated in detail.

The cover provides the light-controlling assembly, the light source module is exposed without housing.

The power supply cavity has the power supply module mounted therein, and the cavity is sealed by the cover. The cover is provided with the light-controlling module which makes the lamp turn itself off in light environment and turn itself on in the dark. One end of the cover connects with the lamp body through the hinge, and the other end provides the openings, the spring plates with hooks are fixed on one end of the lamp body, when the cover is closed, the hooks of the spring plates lock up the openings so as to fix the cover, see FIG. 1. After the spring plates have been pressed inward to loosen the hooks, an upward rotation of the cover could make the cover open.

Referring to FIG. 4, Two sides of the power supply module are provided with the power supply fixation plates, while the power supply cavity has the slots, the power supply fixation plates are inserted into the slots to horizontally mount the power supply module on the bottom of the power supply cavity; when the cover is closed, one end of the light-controlling module which end is inside the cover is pressed against the upper surface of the power supply module, while the lower surface of the power supply module is placed on the bottom of the power supply cavity, thus the power supply module is in contacts with the lamp body and is vertically fixed, that is, the power supply module and the lamp body are fixed together without any screw. When there is a need to replace the power supply module, just open the cover first and then remove the power supply module from the slots.

Referring to FIG. 5, the connection structure between the street lamp connector and the lamp body comprises the internal toothed rings provided by the street lamp connector, independent external toothed rings and the fixation plates provided by the lamp body for fixing the external toothed rings. The internal toothed rings are molded integrally with the street lamp connector, and the fixation plates for fixing the external toothed rings are molded integrally with the lamp body. When installing these components, the external toothed rings are fixed to the fixation plates first, the external toothed rings are then sleeved with the internal toothed rings, bolts are used to pierce the locating slots as well as the locating holes to locate the connector, thereby the angle between the connector and the lamp body can be kept at a designed degree, alternatively, the external toothed rings could be sleeved with the internal toothed rings first and followed by a fixation though bolts, then the external toothed rings are fixed to the fixation plates. The inner diameter of internal toothed rings is slightly larger than the outer diameter of external toothed rings which facilitates the rotation of them when adjusting angles. The internal, toothed rings engage with the external toothed rings at their top to be fixed.

Referring to FIG. 6, the light source assembly is consisted of a plurality of light source modules, these modules are arranged side by side between the two supporting aims, and the modules are bridged on the supporting steps of the supporting arms. Tow ends of each light source module are mounted on the supporting steps through, screws, and there is no connection between any two light source modules, thereby when some of the modules are being maintained, the other modules would not be affected. Tow ends of each module are mounted on the supporting steps through screws. Referring to FIG. 7, the supporting arm is a metal tube, and its cross-section is semicircle shape, the supporting arm is fixed to the side wall of the power supply cavity through bolts. The outside surface of the end cover, the half outside walls of the power supply cavity and the half outside walls of the cover all have the curved surfaces that in accordance with the shape of the supporting arms, which makes the fixation of the supporting arms very stable and strong. The length of the supporting arm could be altered when it is designed so as to get the required length, more light source modules could be mounted when there are longer length supporting arms, which decreases the maintenance costs.

The supporting arm independently constitutes an example of the present invention:

Referring to FIG. 1, a LED street lamp comprises a street lamp connector 10, a power supply assembly 20 and a light source assembly 30.

Referring to FIG. 2, two half outside walls 202, 203 are formed respectively on two sides of the power supply cavity 22 of the power supply assembly 20 when molding it, two cover side walls 204, 205 in accordance with the shape of the half outside walls are provided by two sides of the cover 21, reinforcing beams 206, 207 are arranged between the half outside walls and the side walls and are positioned in the middle portion of the half outside walls or the side walls, the end of the supporting arm 32 which end is fixed to the side wall, is arranged in a space formed by the half outside wall 203 the reinforcing beam 207 and the side wall 201, the space is covered and sealed by the cover side wall, likewise, the supporting arm 31 is arranged with the same mounting structures symmetrically on the opposite side.

Referring to FIG. 6, the light source assembly 30 comprises two supporting arms 31, 32 respectively mounted on side walls 200, 201 of the power supply cavity and a plurality of light source, modules 33 mounted between two said supporting arms, the other end of each of the supporting arms 31, 32 is mounted on an end cover 34 for forming an integrated structure.

The body of the supporting arm 31 is presented as a tube, the outer side of its cross-section is semicircle shape, while the inner side of its cross-section is rectangle shape, the rectangle cross-section has a recess thereon to form a supporting step for mounting light source modules, the supporting step is provided with a plurality of mounting holes for mounting the light source modules, one end of the inner side of the rectangle cross-section is, provided with a plurality of mounting holes for mounting power supply assembly. The supporting arms 31 could be metal tubes.

At one end of the supporting arm, the inner side of said semicircle is provided with a plurality of mounting holes for mounting the end cover.

The structural features of the LED street lamp of the present invention will be illustrated in detail.

The cover provides the light-controlling assembly, the light source module is exposed without housing.

The light source module comprises a lens pressing plate, a lens array, a LED light board and a radiator, the LED light board is mounted on the surface of the radiator, the lens array covers the bulbs arranged on the LED light board, the lens pressing plate covers the lenses and presses the edges of the lenses, the lens pressing plate has an edge to encircle the sides of the radiator, ends of the radiator have mounting holes which enable the radiator to be mounted on the supporting step through screws.

Referring to FIG. 6, the light source assembly is consisted of a plurality of light source modules, these modules are arranged side by side between the two supporting arms, and the modules are bridged on the supporting steps of the supporting aims. Tow ends of each light source module are mounted on the supporting steps through screws, and there is no connection between any two light source modules, thereby when some of the modules are being maintained, the other modules would not be affected. Tow ends of each module are mounted on the supporting steps through screws. Referring to FIG. 7, the supporting arm is a metal tube, and its cross-section is semicircle shape, the supporting arm is fixed to the side wall of the power supply cavity through bolts. The outside surface of the end cover, the half outside walls of the power supply cavity and the half outside walls of the cover all have the curved surfaces that, in accordance with the shape of the supporting arms, which makes the fixation of the supporting arms very stable and strong. The length of the supporting arm could be altered when it is designed so as to get the required length, more light source modules could be mounted when there are longer length supporting arms, which decreases the maintenance costs.

The light source assembly independently constitutes an example of the present invention:

Referring to FIG. 1, a LED street lamp comprises a street lamp connector 10, a power supply assembly 20 and a light source assembly 30.

Referring to FIG. 6, the light source assembly 30 comprises two supporting arms 31, 32 respectively mounted on side walls 200 201 of the power supply cavity and a plurality of light source modules 33 mounted between two said supporting arms, the other end of each of the supporting arms 31, 32 is mounted on an end cover 34 for forming an integrated structure.

Referring to FIG. 6, the supporting arm 31 is a metal tube, and the outer side of the metal tube's cross-section is semicircle shape, the inner side of the supporting arm provides a supporting step 35 having a plurality of mounting holes.

Referring to FIG. 8, FIG. 9*a* and FIG. 9*b*, the light source module 33 comprises a lens pressing plate 301, a lens array 302, a LED light board 303 and a radiator 304, the LED light board 303 is mounted on the surface of the radiator 304, the lens array 302 covers the bulbs arranged on the LED light board 303, the lens pressing plate 301 covers the lenses and presses the edges of the lenses, the lens pressing plate 301 has an edge 305 to encircle the sides of the radiator 304, the ends of the radiator have mounting holes 306 which enable the radiator to be mounted on the supporting step 35 through screws, see FIG. 6.

The structural features of the LED street lamp of the present invention will be illustrated in detail.

Referring to FIG. 6, the light source assembly is consisted of a plurality of light source modules, these modules are arranged side by side between the two supporting arms, and the modules are bridged on the supporting steps of the supporting arms. Tow ends of each light source module are mounted on the supporting steps through screws, and there is no connection between any two light source modules, thereby when some of the modules are being maintained, the other modules would not be affected. Tow ends of each module are mounted on the supporting steps through screws. Referring to FIG. 7, the supporting arm is a metal tube, and its cross-section is semicircle shape, the supporting arm is fixed to the side wall of the power supply cavity through bolts. The outside surface of the end cover, the half outside walls of the power supply cavity and the half outside walls of the cover all have the curved surfaces that in accordance with the, shape of the supporting arms, which makes the fixation of the supporting arms very stable and strong. The length of the supporting arm could be altered when it is designed so as to get the required length, more light source modules could be mounted when there are longer length supporting arms, which decreases the maintenance costs.

Referring to FIG. 8, FIGS. 9*a* and 9*b*, the light source module comprises the lens pressing plate, the lens array, the LED light board and a radiator. The LED light board is mounted on the surface of the radiator, the lens array covers the bulbs that arranged on the LED light board, the lens pressing plate covers the lenses and presses the edges of the lenses, the lens pressing plate has an edge to encircle the sides of the radiator, which improves the waterproof performance of the LED street lamp. The radiator is consisted of heat diffusion substrates and a plurality of heat diffusion slices arranged perpendicular to the substrates. The substrate is presented as a cuboid structure.

Industrial applications of the LED street lamp of the present invention.

The foregoing three examples of the present invention has been presented for the purpose of illustration and description. It is not intended to be exhaustive to limit the invention to the precise form disclosed, and obviously many modifications and variations in regarding to the light source assembly, the power supply assembly and the supporting arms are possible in light of the above teaching. Such modification and variations that may be apparent to those skilled in the art are intended to be included within the scope of this invention as defined by the accompanying claims.

What is claimed is:

1. A LED street lamp comprising:

a power supply assembly, comprising a power supply body carrying with a cover and a circuit module, one end of the cover being connected with the power supply body through a hinge, a structure of power supply cavity with two side walls being formed when molding the power supply body, two half outside walls being formed respectively on two sides of the power supply cavity when molding it, two cover side walls in accordance with the shape of the half outside walls being provided by two sides of the cover, a reinforcing beam being arranged between the half outside wall and the side wall and being positioned in the middle portion of the half outside wall or the, side wall, space being formed by the half outside wall, the reinforcing beam and the side wall, the space being covered and sealed by the cover side wall;

a light source assembly, comprising two supporting arms respectively mounted on the side walls of the power supply cavity and a plurality of light source modules mounted between two said supporting arms. one end of each of the supporting arms being mounted in said space, while the other end being mounted on an end cover for forming an integrated structure: and a street lamp connector, being rotatablely connected to the power supply body at its end.

2. The LED street lamp as claimed in claim 1, wherein the street lamp connector characteristic of hollow T-shape, has two internal toothed rings with locating slots respectively provided on two side of one end of the street lamp connector; external toothed rings are mounted on two fixation plates respectively which are arranged on one end of the power supply body. the external toothed rings are sleeved with the internal toothed rings, via a screw pierced a screw hole of the external toothed ring to locate in a locating slot provided by the internal toothed ring to achieve rotatable connection therebetween.

3. The LED street lamp as claimed in claim 1, wherein the cover of the power supply assembly has openings at the other end thereof, spring plates with hooks are fixed on one end of the power supply body, when the cover is closed, the hooks of the spring plates lock up the openings so as to fix the cover, after the spring plates have been pressed inward to loosen the hooks, an upward rotation of the cover could make the cover open.

4. The LED street lamp as claimed in claim 1, wherein the circuit module comprises a light-controlling module and a power supply module, the light-controlling module is mounted in a through-hole provided by the cover, and the power supply module is mounted in the power supply cavity.

5. The LED street lamp as claimed in claim 4, wherein two sides of the power supply module are provided with power supply fixation plates, while the power supply cavity has slots, the power supply fixation plates are inserted into the slots to horizontally mount the power supply module on the bottom of the power supply cavity; when the cover is closed, one end of the light-controlling module which end is inside the cover is pressed against an upper surface of the power supply module.

6. The LED street lamp as claimed in claim 1, wherein the supporting arm is a metal tube, and the outer side of the metal tube's cross-section is semicircle shape, the inner side of the supporting arm provides a supporting step having a plurality of mounting holes.

7. The LED street lamp as claimed in claim 6, wherein the light source module comprises a lens pressing plate, a lens array, a LED light board and a radiator, the LED light board is mounted on the surface of the radiator, the lens array covers the bulbs arranged on the LED light board, the lens pressing plate covers the lenses and presses the edges of the lenses, the lens pressing plate has an edge to encircle the sides of the radiator, the ends of the radiator have mounting holes which enable the radiator to be mounted on the supporting step through screws.

8. A power supply assembly of LED street lamp comprising a power supply body carrying with a cover and a circuit module, one end of the cover being connected with the power supply body through a hinge, a structure of power supply cavity with two side walls being formed when molding the power supply body, two half outside walls being formed respectively on two sides of the power supply cavity of the power supply body when molding it, two cover side walls in accordance with the shape of the half outside walls being provided by two sides of the cover, a reinforcing beam being arranged between the half outside wall and the side wall and being positioned in the middle portion of the half outside wall or the side wall, space being formed by the half outside wall, the reinforcing rib and the side wall, the space being covered and sealed by the cover side wall.

9. A street lamp connector of LED street lamp, characterized in that the street lamp connector characteristic of hollow T-shape, has two internal toothed rings with locating slots respectively provided on two side of one end of the street lamp connector.

10. A power supply assembly of LED street lamp carrying with a rotary connector comprising:

a cover being connected with the power supply body through a hinge;

a power supply body, a structure of power supply cavity with two side walls being formed when molding the power supply body, two half outside walls being formed respectively on two sides of the power supply cavity when molding it, two cover side walls in accordance with the shape of the half outside walls being provided by the two sides of the cover, a reinforcing beam being arranged between the half outside wall and the side wall and being positioned in the middle portion of the half outside wall or the side wall, space being formed by the half outside wall, the reinforcing beam and the side wall, the space being covered and sealed by the cover side wall;

a street lamp connector, being rotatablely connected to the power supply body at its end.

11. The power supply assembly of LED street lamp as claimed in claim 10, wherein the street lamp connector characteristic of hollow T-shape, has two internal toothed rings with locating slots respectively provided on two side of one end of the street lamp connector; external toothed rings are mounted on two fixation plates respectively which are arranged on one end of the power supply body, the external toothed rings are sleeved with the internal toothed rings, via a screw pierced a screw hole of the external toothed ring to locate in a locating slot provided by the internal toothed ring to achieve rotatable connection therebetween.

12. The power supply assembly of LED street lamp as claimed in claim 10, wherein the power supply body comprises a power supply module and a light-controlling module, the light-controlling module is mounted in a through-hole provided by the cover, and the power supply module is mounted in the power supply cavity

13. The power supply assembly of LED street lamp as claimed in claim 12, wherein two sides of the power supply module are provided with power supply fixation plates, while the power supply cavity has slots, the power supply fixation plates are inserted into the slots to horizontally mount the power supply module on the bottom of the power supply cavity; when the cover is closed, one end of the light-controlling module which end is inside the cover is pressed against an upper surface of the power supply module.

14. The power supply assembly of LED street lamp as claimed in claim 13, wherein the cover has openings at the other end thereof, spring plates with hooks are fixed on one end of the power supply body, when the cover is closed, the hooks of the spring plates lock up the openings so as to fix the cover, after the spring plates have been pressed inward to loosen the hook, an upward rotation of the cover could make the cover open.

15. The power supply assembly of LED street lamp as claimed in claim 10, wherein the cover has openings at the other end thereof, spring plates with hooks are fixed on one end of the power supply body, when the cover is closed, the hooks of the spring plates lock up the openings so as to fix the cover, after the spring, plates have been pressed inward to loosen the hook, an upward rotation of the cover could make the cover open.

16. A power supply body of LED street lamp, characterized in that: a structure of power supply cavity with two side walls is formed when molding the power supply body, two half outside walls are formed respectively on two sides of the power supply cavity, two cover side walls in accordance with the shape of the half outside walls are provided by two sides of a cover, a reinforcing beam is arranged between the half outside wall and the side wall and, is positioned in the middle portion of the half outside wall or the side wall, space is formed by the half outside wall, the reinforcing beam and the side wall, the space is covered and sealed by the cover side wall.

* * * * *